US010194231B2

(12) United States Patent
Su et al.

(10) Patent No.: US 10,194,231 B2
(45) Date of Patent: Jan. 29, 2019

(54) CIRCUIT FOR DETECTING BUTTON ACTION ON EARPHONE, TERMINAL, AND EARPHONE

(71) Applicant: Huawei Technologies Co., Ltd., Shenzhen (CN)

(72) Inventors: Wei Su, Shenzhen (CN); Huogen Kuang, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 163 days.

(21) Appl. No.: 15/106,992

(22) PCT Filed: May 30, 2014

(86) PCT No.: PCT/CN2014/079001
§ 371 (c)(1),
(2) Date: Jun. 21, 2016

(87) PCT Pub. No.: WO2015/180172
PCT Pub. Date: Dec. 3, 2015

(65) Prior Publication Data

US 2017/0127169 A1 May 4, 2017

(51) Int. Cl.
*H04R 1/10* (2006.01)
*H04R 29/00* (2006.01)

(52) U.S. Cl.
CPC ..... *H04R 1/1041* (2013.01); *H04R 1/1025* (2013.01); *H04R 29/004* (2013.01);
(Continued)

(58) Field of Classification Search
CPC .. H04R 1/1041; H04R 1/1016; H04R 29/004; H04R 5/04; H04R 5/033; H04R 2420/03;
(Continued)

(56) References Cited

U.S. PATENT DOCUMENTS 7,623,667 B2 11/2009 Sander et al.
8,548,175 B2 10/2013 Im et al.
(Continued)

FOREIGN PATENT DOCUMENTS

CN 101841753 A 9/2010
CN 102624957 A 8/2012
(Continued)

*Primary Examiner* — Matthew Eason
*Assistant Examiner* — Sabrina Diaz
(74) *Attorney, Agent, or Firm* — Slater Matsil, LLP

(57) ABSTRACT

A circuit for detecting a button action on an earphone, including a first resistor, a comparator having with a first input end, a second input end, and an output end, with the first input end of the comparator connected to the first end of the first resistor, and the second input end of the comparator connected to the second end of the first resistor. A power supply us connected to the first resistor. The earphone includes a second resistor, and when the earphone is connected to the circuit, the second resistor is connected to the first resistor. The earphone further includes a microphone having a first end connected to the first end of the second resistor and a second end grounded, and a button having ends that are respectively connected the microphone and the second resistor. When the button is pressed, the ends of the button are connected.

10 Claims, 3 Drawing Sheets

(52) U.S. Cl.
CPC .... *H04R 2201/107* (2013.01); *H04R 2420/05* (2013.01); *H04R 2420/09* (2013.01)

(58) Field of Classification Search
CPC ..... H04R 2420/09; H04R 2420/05; H04R 2420/07
USPC ..... 381/74
See application file for complete search history.

(56) References Cited

U.S. PATENT DOCUMENTS

| | | | | |
|---|---|---|---|---|
| 2010/0303251 | A1* | 12/2010 | Im | H04R 1/1041 381/74 |
| 2012/0237044 | A1* | 9/2012 | Poulsen | H04R 1/1041 381/58 |
| 2013/0089216 | A1 | 4/2013 | Han | |
| 2014/0064512 | A1* | 3/2014 | Yu | H01R 24/58 381/74 |

FOREIGN PATENT DOCUMENTS

| | | | |
|---|---|---|---|
| EP | 1976246 | A1 | 10/2008 |
| JP | 2014050108 | A | 3/2014 |
| KR | 20130036906 | A | 4/2013 |
| WO | 2008028175 | A2 | 3/2008 |

* cited by examiner

CIRCUIT FOR DETECTING BUTTON ACTION ON EARPHONE, TERMINAL, AND EARPHONE

CROSS-REFERENCE TO RELATED APPLICATIONS

This patent application is a national phase filing under section 371 of PCT/CN2014/079001, filed May 30, 2014 which is incorporated herein by reference in its entirety.

TECHNICAL FIELD

Embodiments of the present invention relate to circuit detection technologies, and in particular, to a circuit for detecting a button action on an earphone, a terminal, and an earphone.

BACKGROUND

Currently, all ordinary earphones are provided with a button used to switch between songs in music listening or answer a call for a conversation. Generally, most buttons are implemented in circuits by short-circuiting microphone (MIC) lines of earphones, that is, by connecting a button and a MIC in parallel. When the button is pressed, no voltage exists at two ends of the MIC because the MIC is short-circuited; when the button is not pressed, voltages exist in circuits of the two ends of the MIC. Therefore, when an earphone is inserted into a terminal device, such as a mobile phone or a computer, the terminal device may determine, by monitoring voltages at two ends of a MIC, whether a button is pressed, and thereby implement a corresponding function.

With continuous development of technologies, ordinary earphones gradually evolve into noise reduction earphones with a four-conductor plug. In a noise reduction earphone with a four-conductor plug, a MIC line needs to be used also as a power line (also referred to as a charge line). In this case, if the button is still implemented according to a circuit in an ordinary earphone, because one end of a parallel circuit is connected to a power supply, and the other end is grounded, when the button is pressed, the power line is directly short-circuited to ground, resulting in circuit burn-out and causing a great potential risk.

Therefore, a problem to be solved urgently in the industry is how to detect a button on a noise reduction earphone with a four-conductor plug and further implement a corresponding function according to a detected state.

SUMMARY

Embodiments of the present invention provide a circuit for detecting a button action on an earphone, a terminal, and an earphone to detect a button state of a noise reduction earphone with a four-conductor plug and further implement a corresponding function according to the detected state.

According to a first aspect, an embodiment of the present invention provides a circuit for detecting a button action on an earphone, where the circuit includes: a first resistor, provided with a first end and a second end;

a comparator, provided with a first input end, a second input end, and an output end, where the first input end of the comparator is connected to the first end of the first resistor, and the second input end of the comparator is connected to the second end of the first resistor; and a power supply connected to the first end of the first resistor; where the earphone includes:

a second resistor, including a first end and a second end, where when the earphone is connected to the circuit, the first end of the second resistor is connected to the second end of the first resistor;

a microphone MIC, including a first end and a second end, where the first end of the MIC is connected to the first end of the second resistor, and the second end of the MIC is grounded; and a button, whose two ends are respectively connected to the second end of the MIC and the second end of the second resistor, where when the button is pressed, the two ends of the button are electrically connected.

In a first possible implementation manner of the first aspect, the circuit further includes: a first analog to digital converter ADC and a second ADC, where the first ADC is connected to the first end of the first resistor, and the second ADC is connected to the second end of the first resistor.

According to a second aspect, an embodiment of the present invention provides a terminal capable of being connected to an earphone through an earphone interface, where the terminal includes:

a first resistor, provided with a first end and a second end;

a comparator, provided with a first input end, a second input end, and an output end, where the first input end of the comparator is connected to the first end of the first resistor, and the second input end of the comparator is connected to the second end of the first resistor; and configured to output a control signal at the output end of the comparator when a voltage difference between the first input end and the second input end is greater than a first threshold; and a power supply connected to the first end of the first resistor; where the earphone includes:

a second resistor, including a first end and a second end, where when the earphone is connected to the terminal through the earphone interface, the first end of the second resistor is connected to the second end of the first resistor;

a microphone MIC, including a first end and a second end, where the first end of the MIC is connected to the first end of the second resistor, and the second end of the MIC is grounded; and a button, whose two ends are respectively connected to the second end of the MIC and the second end of the second resistor, where when the button is pressed, the two ends of the button are electrically connected; and the terminal further includes:

a processor, configured to receive the control signal, and execute a function corresponding to the control signal.

In a first possible implementation manner of the second aspect, the terminal further includes:

a first analog to digital converter ADC, where an input end of the first ADC is connected to the first end of the first resistor, and an output end of the first ADC is connected to the processor; and a second ADC, where an input end of the second ADC is connected to the second end of the first resistor, and an output end of the second ADC is connected to the processor; where the processor is further configured to read an output value of the first ADC and an output value of the second ADC, and compare the output value of the first ADC with the output value of the second ADC, and when a difference between the output value of the first ADC and the output value of the second ADC is greater than a second threshold, determine that the power supply is charging the earphone.

According to a third aspect, an embodiment of the present invention provides an earphone, including:

a second resistor, including a first end and a second end, where when the earphone is inserted into a terminal through an earphone interface, the first end of the second resistor is connected to a second end of a first resistor;

a microphone MIC, including a first end and a second end, where the first end of the MIC is connected to the first end of the second resistor, and the second end of the MIC is grounded; and a button, whose two ends are respectively connected to the second end of the MIC and the second end of the second resistor, where when the button is pressed, the two ends of the button are electrically connected; where the terminal includes:

the first resistor, provided with a first end and the second end;

a comparator, provided with a first input end, a second input end, and an output end, where the first input end of the comparator is connected to the first end of the first resistor, and the second input end of the comparator is connected to the second end of the first resistor; and configured to output a control signal at the output end of the comparator when a voltage difference between the first input end and the second input end is greater than a threshold; and a power supply connected to the first end of the first resistor.

With the circuit for detecting a button action on an earphone, the terminal, and the earphone provided by the embodiments of the present invention, a terminal device detects a button state by using a button detection circuit, and executes a corresponding action. In the button detection circuit, when a button is in a pressed state, there is resistance between the button and a power supply. Therefore, circuit burnout caused by direct grounding of the power supply is avoided, and detection of the button state of the earphone is implemented.

DETAILED DESCRIPTION OF ILLUSTRATIVE EMBODIMENTS

To make the objectives, technical solutions, and advantages of the embodiments of the present invention clearer, the following clearly and completely describes the technical solutions in the embodiments of the present invention with reference to the accompanying drawings in the embodiments of the present invention. Apparently, the described embodiments are some but not all of the embodiments of the present invention. All other embodiments obtained by persons of ordinary skill in the art based on the embodiments of the present invention without creative efforts shall fall within the protection scope of the present invention.

Figure 1:
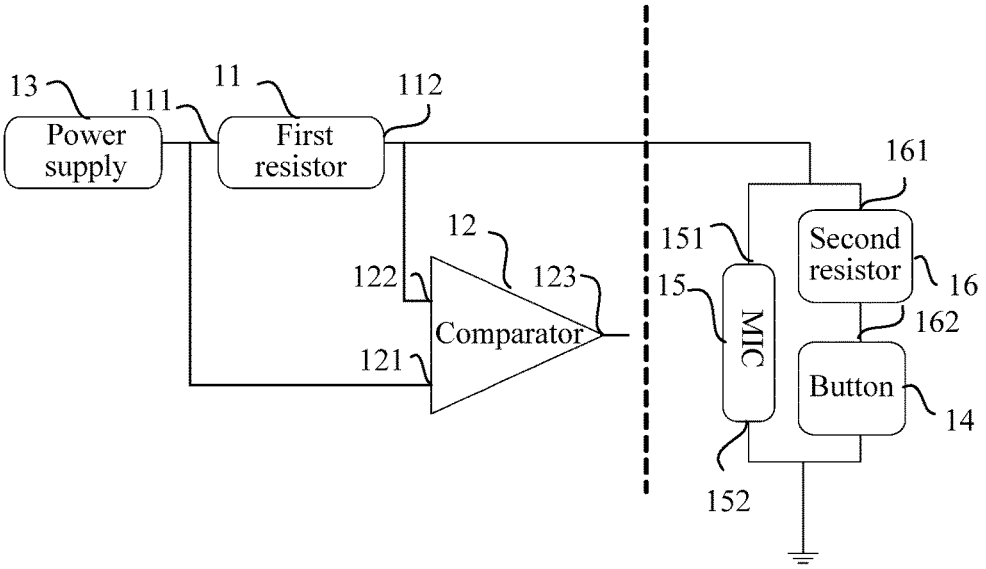
FIG. 1 is an equivalent circuit diagram of a circuit for detecting a button action on an earphone according to an embodiment of the present invention.

FIG. 1 is an equivalent circuit diagram of a circuit for detecting a button action on an earphone according to an embodiment of the present invention. As shown in FIG. 1, the detection circuit includes a first resistor 11, a comparator 12, a power supply 13, a button 14, a MIC 15, and a second resistor 16, where the first resistor 11 is provided with a first end in and a second end 112, the MIC 15 is provided with a first end 151 and a second end 152, and the second resistor 16 is provided with a first end 161 and a second end 162. The first end 111 of the first resistor 11 is connected to the power supply 13. The second end 112 of the first resistor 11 is connected to the first end 151 of the MIC 15 and the first end 161 of the second resistor 16. The comparator 12 is provided with a first input end 121, a second input end 122, and an output end 123. The first input end 121 of the comparator 12 is connected to the first end 111 of the first resistor 11. The second input end 122 of the comparator 12 is connected to the second end 112 of the first resistor 11. Two ends of the button 14 are respectively connected to the second end 152 of the MIC 15 and the second end 162 of the second resistor 16. When the button 14 is pressed, the two ends of the button 14 are electrically connected. The second end 152 of the MIC 15 is grounded.

Referring to FIG. 1, the detection circuit is equivalent to a button detection circuit. When the button 14 is in a pressed state, the MIC 15 and the second resistor 16 are connected in parallel. Because a resistance value of the MIC is relatively large, a parallel resistance value after the MIC 15 and the second resistor 16 are connected in parallel is approximately equal to a resistance value of the second resistor 16. In this case, because the two input ends of the comparator 12 are respectively connected to the two ends of the first resistor 11, a voltage difference between the two input ends of the comparator 12 is a voltage difference between the two ends of the first resistor 11, but a voltage difference between the two ends of the first resistor 11 depends on a current that flows through the first resistor 11. If the resistance value of the second resistor 16 is smaller, the current that flows through the first resistor 11 is stronger, and the voltage difference between the two ends of the first resistor 11 is greater. When the voltage difference is greater than a value, the output end 123 outputs an interrupt signal to a processor (not shown in the figure), for example, a central processing unit (Central Processing Unit, CPU), and the processor implements a corresponding function.

When the button 14 is in an unpressed state, the second resistor 16 is disconnected. The current on the first resistor 11 depends on the resistance value of the MIC 15, where the resistance value of the MIC 15 is fixed and relatively large, the current that flows through the first resistor 11 is weak, and the voltage difference between the two ends of the first resistor 11 is small. In this case, the comparator does not output an interrupt signal to the processor.

As may be known from FIG. 1, due to protection of the first resistor 11 and second resistor 16, when the button 14 is in the pressed state, circuit burnout caused by direct grounding of the power supply 13 can be avoided.

Figure 2:
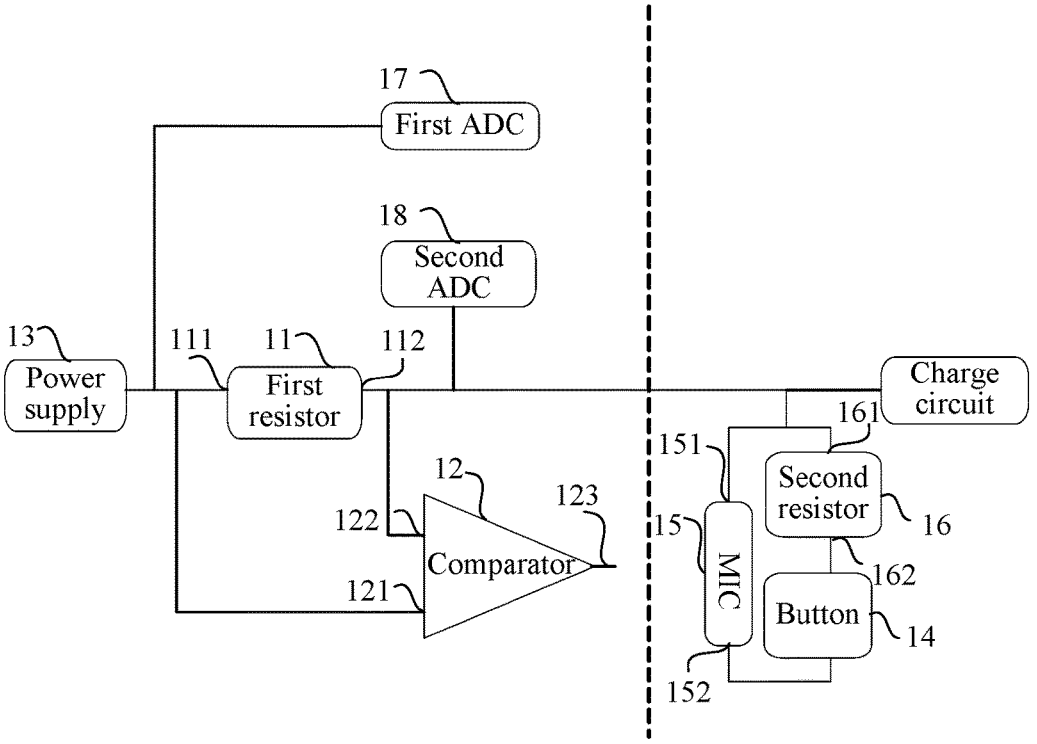
FIG. 2 is an equivalent circuit diagram of a circuit for detecting a button action on an earphone according to another embodiment of the present invention.

FIG. 2 is an equivalent circuit diagram of a circuit for detecting a button action on an earphone according to another embodiment of the present invention. As shown in FIG. 2, on a basis of the foregoing circuit shown in FIG. 1, the detection circuit provided by the embodiment further includes: a first analog to digital converter (ADC) 17 and a second ADC 18, where the first ADC 17 is connected to the first end in of the first resistor 11, and the second ADC 18 is connected to the second end 112 of the first resistor 11.

Referring to FIG. 2, the parts except the comparator 12 in the detection circuit are equivalent to a recognition circuit. When one end of a parallel circuit formed by connecting the button 14 and the second resistor 16 that are connected in series, to the MIC 15 in parallel, is connected to a charge circuit (shown by the gray padding in the figure), because the power supply 13 supplies power to the charge circuit, the current that flows through the first resistor 11 is strong, and voltages exist at the two ends of the first circuit 11. In this case, the voltage at the first end 111 is an input of the first ADC 17, and the voltage at the second end 112 is an input of the second ADC 18. When a difference between the first ADC 17 and the second ADC 18 is greater than a specific value, it indicates that a charge circuit exists in the circuit. When one end of the parallel circuit formed by connecting the button 14 and the second resistor 16 that are connected in series, to the MIC 15 in parallel, is not connected to the charge circuit (shown by the gray padding in the figure), the current that flows through the first resistor 11 is weak, and therefore the difference between the first ADC 17 and the second ADC 18 is very small and may be ignored. In this case, it indicates that no charge circuit exists in the circuit. The difference between the first ADC 17 and the second ADC 18 may be understood as a result that is obtained after a difference between a binary sequence obtained by the first ADC 17 and a binary sequence obtained by the second ADC 18 is converted into a decimal. In a specific implementation process, both the first ADC 17 and the second ADC 18 may be connected to the processor, and the processor reads and compares numeric values of the first ADC 17 and second ADC 18.

Still referring to FIG. 1 and FIG. 2, in a possible implementation manner, generally components on the left side of the dotted line and components on the right side may be located in different devices. For example, components on the left side of the dotted line may be disposed in a terminal device, and components on the right side of the dotted line may be disposed in an earphone, and when the earphone is inserted into the terminal device, the foregoing button detection function and charge circuit recognition function are implemented.

It should be noted that in the foregoing embodiment, different ADCs may be selected according to requirements. For example, 12-bit ADCs or ADCs of other quantities of bits may be selected as the first ADC 17 and second ADC 18.

Figure 3:
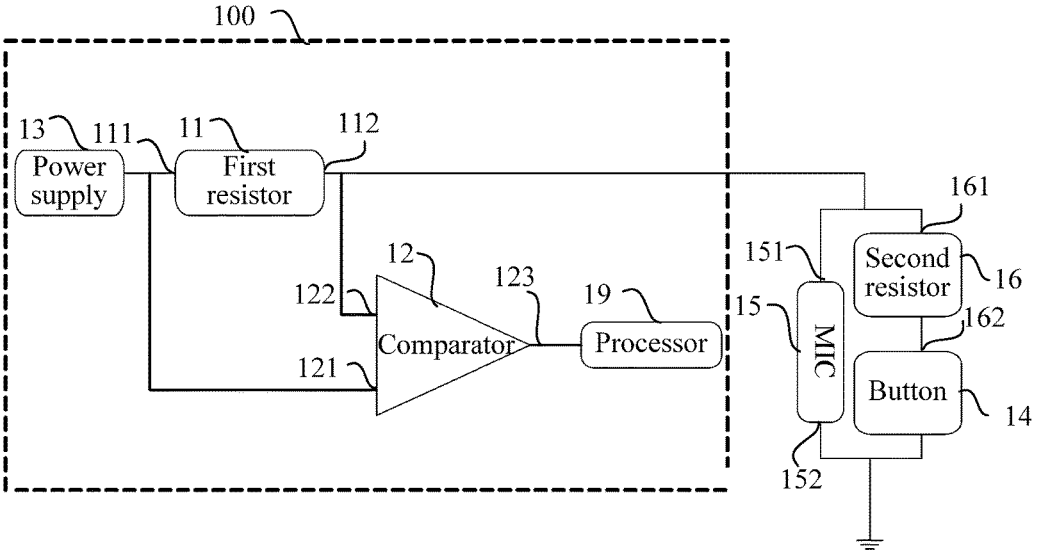
FIG. 3 is a schematic structural diagram of a terminal capable of being connected to an earphone through an earphone interface according to an embodiment of the present invention.

FIG. 3 is a schematic structural diagram of a terminal capable of being connected to an earphone through an earphone interface according to an embodiment of the present invention. As shown in FIG. 3, the terminal 100 provided by the embodiment includes: a first resistor 11, provided with a first end in and a second end 112;

a comparator 12, provided with a first input end 121, a second input end 122, and an output end 123, where the first input end 121 of the comparator 12 is connected to the first end 111 of the first resistor 11, and the second input end 122 of the comparator 12 is connected to the second end 112 of the first resistor 11; and configured to output a control signal at the output end 123 of the comparator 12 when a voltage difference between the first input end 121 and the second input end 122 is greater than a threshold; and a power supply 13 connected to the first end 111 of the first resistor 11; where the earphone includes:

a second resistor 16, including a first end 161 and a second end 162, where when the earphone is connected to the terminal 100 through the earphone interface, the first end 161 of the second resistor 16 is connected to the second end 162 of the first resistor 16;

a microphone MIC 15, including a first end 151 and a second end 152, where the first end 151 of the MIC 15 is connected to the first end 161 of the second resistor 16, and the second end 152 of the MIC 15 is grounded; and a button 14, whose two ends are respectively connected to the second end 152 of the MIC 15 and the second end 162 of the second resistor 16, where when the button 14 is pressed, the two ends of the button 14 are electrically connected; and the terminal 100 further includes:

a processor 19, configured to receive the control signal, and execute a function corresponding to the control signal.

Figure 4:
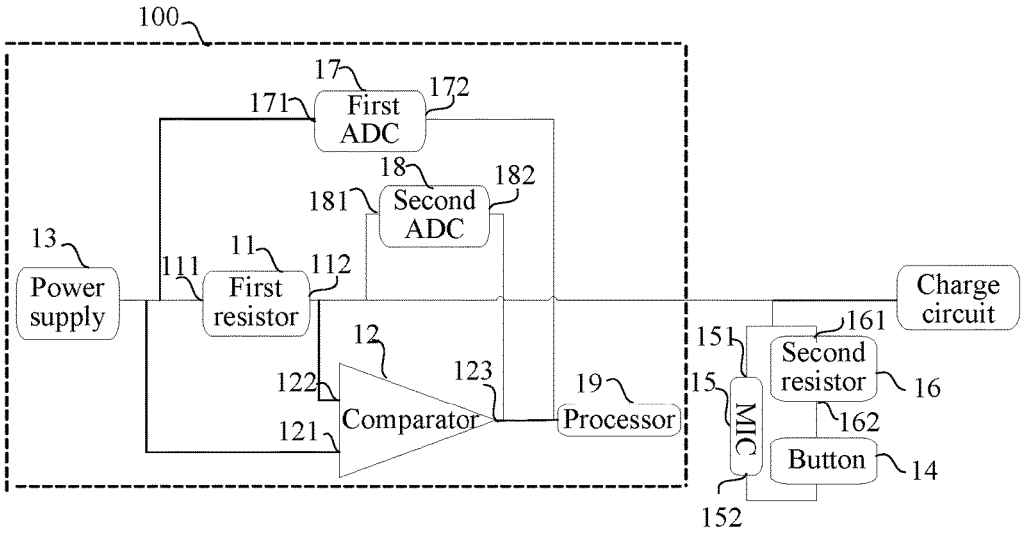
FIG. 4 is a schematic structural diagram of a terminal capable of being connected to an earphone through an earphone interface according to another embodiment of the present invention.

FIG. 4 is a schematic structural diagram of a terminal capable of being connected to an earphone through an earphone interface according to another embodiment of the present invention. As shown in FIG. 4, optionally, on a basis of the foregoing terminal shown in the FIG. 3, the terminal 100 provided by the embodiment further includes:

a first analog to digital converter ADC 17, where an input end 171 of the first ADC is connected to the first end 111 of the first resistor 11, and an output end 172 of the first ADC 17 is connected to the processor 19; and a second ADC 18, where an input end 181 of the second ADC 18 is connected to the second end 112 of the first resistor 11, and an output end 182 of the second ADC 18 is connected to the processor 19. In a process of identifying an earphone type, the processor 19 is further configured to read an output value of the first ADC 17 and an output value of the second ADC 18, and compare the output value of the first ADC 17 with the output value of the second ADC 18, and when a difference between the output value of the first ADC 17 and the output value of the second ADC 18 is greater than a second threshold, determine that the power supply is charging the earphone and thereby identify the earphone type. That is, if the difference between the output value of the first ADC 17 and the output value of the second ADC 18 is greater than the second threshold, the terminal 100 determines that a charge circuit exists in the earphone and that the earphone is a noise reduction earphone; otherwise, if the difference between the output value of the first ADC 17 and the output value of the second ADC 18 is not greater than the second threshold, the terminal 100 determines that no charge circuit exists in the earphone and that the earphone is an ordinary earphone with a four-conductor plug.

Working principles of the foregoing terminal in FIG. 3 and FIG. 4 are not further described herein. Reference may be made to the embodiments shown in FIG. 1 and FIG. 2.

Figure 5:
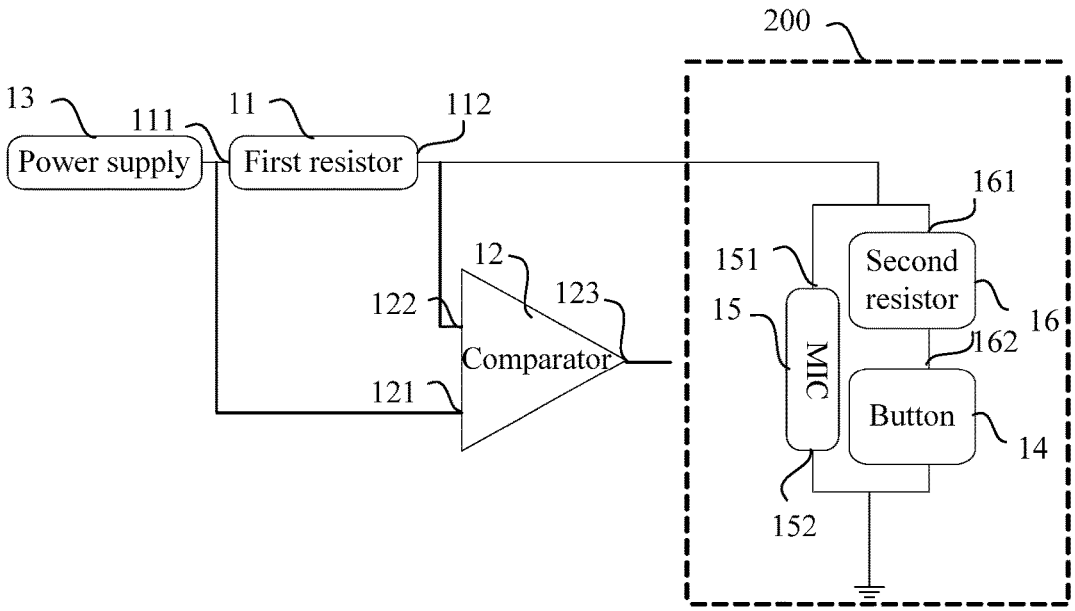
FIG. 5 is a schematic structural diagram of an earphone according to an embodiment of the present invention.

FIG. 5 is a schematic structural diagram of an earphone according to an embodiment of the present invention. As shown in FIG. 5, the earphone 200 provided by the embodiment includes:

a second resistor 16, including a first end 161 and a second end 162, where when the earphone 200 is inserted into a terminal through an earphone interface, the first end 161 of the second resistor 16 is connected to a second end 111 of a first resistor 11;

a microphone MIC 15, including a first end 151 and a second end 152, where the first end 151 of the MIC 15 is connected to the first end 161 of the second resistor 16, and the second end 152 of the MIC 15 is grounded; and a button 14, whose two ends are respectively connected to the second end 152 of the MIC 15 and the second end 162 of the second resistor 16, where when the button 14 is pressed, the two ends of the button 14 are electrically connected; where the terminal includes: the first resistor 11, provided with a first end 111 and the second end 112;

a comparator 12, provided with a first input end 121, a second input end 122, and an output end 123, where the first input end 121 of the comparator 12 is connected to the first end 111 of the first resistor 11, and the second input end 122 of the comparator 12 is connected to the second end 112 of the first resistor 11; and configured to output a control signal at the output end 123 of the comparator 12 when a voltage difference between the first input end 121 and the second input end 122 is greater than a threshold; and a power supply 13 connected to the first end 111 of the first resistor 11.

Figure 6:
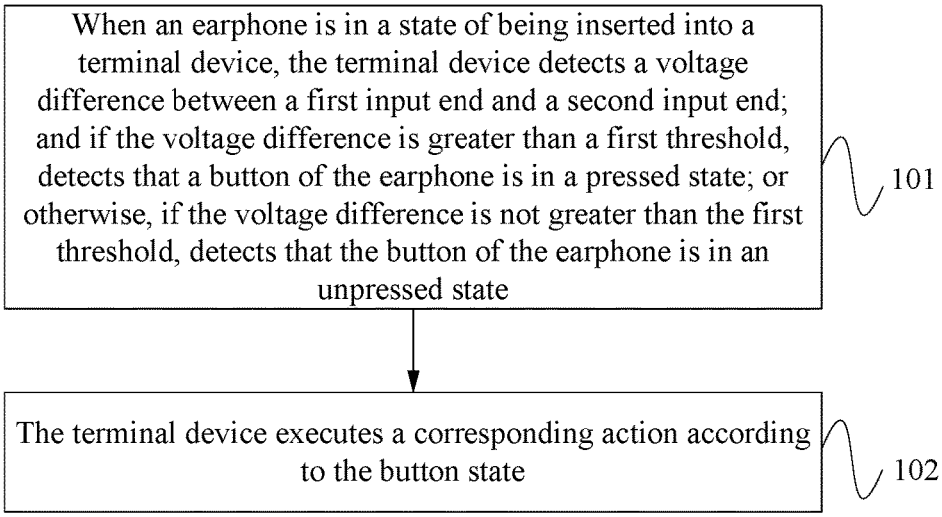
FIG. 6 is a flowchart of a detection method according to an embodiment of the present invention.

FIG. 6 is a flowchart of a detection method according to an embodiment of the present invention. Reference may also be made to FIG. 1. In the embodiment, components on the left side of the dotted line are disposed in a terminal device, and components on the right side of the dotted line are disposed in an earphone. The solution is applicable to a terminal device that supplies power to an earphone in which a MIC line is used also as a power line. Specifically, the embodiment includes the following steps:

101. When an earphone is in a state of being inserted into a terminal device, the terminal device detects a voltage difference between a first input end and a second input end; and if the voltage difference is greater than a first threshold, detects that a button of the earphone is in a pressed state; or otherwise, if the voltage difference is not greater than the first threshold, detects that the button of the earphone is in an unpressed state.

In this step, the terminal device detects voltages at two ends of a first resistor by using a button detection circuit. The specific implementation principle is not further described herein. Reference may be made to the foregoing embodiment in FIG. 1.

102. The terminal device executes a corresponding action according to the button state.

After detecting the button state, the terminal device executes the corresponding action. For example, if the terminal device is playing a song, when detecting that the button is in the pressed state, the terminal device executes a song switching action; for another example, if the terminal device is playing a song, when there is an incoming call, a user presses the button, and in this case, the terminal device detects that the button is in the pressed state and connects the call. In addition, functions such as fast forward and fast rewind may be implemented according to a duration for which the button is in the pressed state and the number of continuous presses; however, the present invention is not limited thereto.

In the detection method provided by the embodiment of the present invention, a terminal device detects a button state by using a button detection circuit, and executes a corresponding action. In the button detection circuit, when a button is in a pressed state, there is resistance between the button and a power supply. Therefore, circuit burnout caused by direct grounding of the power supply is avoided, and detection of the button state of the earphone is implemented.

Further, in the embodiment shown in FIG. 6, the earphone may be, for example, a noise reduction earphone with a noise reduction function. Because the terminal device needs to supply power to a module for implementing the noise reduction function in the noise reduction earphone, the noise reduction earphone is an earphone that uses a MIC line also as a power line. In this case, to distinguish the earphone type, the terminal device may further be provided with an earphone detection circuit. The earphone detection circuit includes: a first analog to digital converter ADC and a second ADC, where the first ADC is connected to a first end of a first resistor, and the second ADC is connected to a second end of the first resistor. When the earphone is in a state of being inserted into the terminal device, the terminal device determines whether a difference between the first ADC and the second ADC is greater than a second threshold; and if the difference is greater than the second threshold, detects that the earphone type is a noise reduction earphone; or otherwise, if the difference is not greater than the second threshold, detects that the earphone type is not a noise reduction earphone. Specifically, reference may be made to the foregoing circuit shown in FIG. 2, and no further description is provided herein.

Optionally, in the foregoing embodiment shown in FIG. 6, the power supply is a 5-volt power supply; a resistance value of the first resistor is 10 ohm; the first threshold is 0.5 volts; and a resistance value of a second resistor is 40 ohm. When the detection circuit executes the button detection function, if the button is in the pressed state, a current that flows through the first resistor is about $5V/(10+40)\Omega=0.1$ A, and a voltage difference between two ends of the first resistor is 1V, that is, the voltage difference between the two ends of the first resistor is greater than the first threshold 0.1 volts. In this case, a comparator detects the voltage difference between the two ends of the first resistor and generates an interrupt signal, and outputs the interrupt signal from an output end of the comparator to a CPU. Thereby, the CPU detects that the button is in the pressed state and executes the corresponding action. However, if the button is in the unpressed state, because a resistance value of a MIC is relatively large, the resistance value of the first resistor may be ignored. In this case, the current that flows through the first resistor is very weak. Therefore, the voltage difference between the two ends of the first resistor is also very small, and the comparator does not output any interrupt signal.

It should be noted that in the foregoing embodiment, the present invention is described in detail by using an example in which the first threshold is 0.1 volts; however, the present invention is not limited thereto. In other feasible implementation manners, the first threshold may also be other values. For example, different values may be used as the first threshold according to precision of the comparator.

Further, optionally, in the foregoing embodiment shown in FIG. 6, the second threshold may be, for example, 1 volt. When the detection circuit executes an earphone identification function, that is, when it is necessary to distinguish an ordinary earphone with a four-conductor plug from a noise reduction earphone, the terminal device implements the earphone identification function by detecting the difference between the first ADC and the second ADC. Specifically, when the earphone is a noise reduction earphone, because the terminal device charges a noise reduction function module of the noise reduction earphone, the current that flows through the first resistor is about 15 MA; therefore a voltage difference exists between the two ends of the first resistor. The difference between the first ADC and the second ADC is about 150 millivolts (MV), that is, the difference between the first ADC and the second ADC is greater than the second threshold 20 MV. In this case, the terminal device detects that the earphone is a noise reduction earphone. Otherwise, if an ordinary earphone is inserted, the terminal device does not need to charge the earphone; therefore the current that flows through the first resistor is very weak and may almost be ignored, and the difference between the first ADC and the second ADC is approximately 0. In this case, the terminal device detects that the earphone is an ordinary earphone with a four-conductor plug.

It should be noted that in the foregoing embodiment, the present invention is described in detail by using an example in which the second threshold is 20 MV; however, the present invention is not limited thereto. In other feasible implementation manners, the second threshold may also be other values.

Persons of ordinary skill in the art may understand that all or some of the steps of the method embodiments may be implemented by a program instructing relevant hardware. The program may be stored in a computer-readable storage medium. When the program runs, the steps of the method embodiments are performed. The foregoing storage medium includes: any medium that can store program code, such as a ROM, a RAM, a magnetic disk, or an optical disc.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A circuit for detecting a button action on an earphone, the circuit comprising:

a first resistor, having a first end and a second end;

a comparator, having a first input end, a second input end, and an output end, wherein the first input end of the comparator is connected to the first end of the first resistor, and the second input end of the comparator is connected to the second end of the first resistor, and wherein the comparator is configured to output a control signal at the output end of the comparator according to a relationship between a voltage difference between the first input end of the comparator and the second input end of the comparator and a predetermined value; and a power supply connected to the first end of the first resistor;

a first analog to digital converter (ADC); and a second ADC;

wherein the first ADC is connected to the first end of the first resistor, and wherein the second ADC is connected to the second end of the first resistor;

wherein the earphone comprises:

a second resistor, having a first end and a second end, wherein when the earphone is connected to the circuit, the first end of the second resistor is connected to the second end of the first resistor;

a microphone (MIC), having a first end and a second end, wherein the first end of the MIC is connected to the first end of the second resistor, and the second end of the MIC is grounded; and a button having two ends that are respectively connected to the second end of the MIC and the second end of the second resistor, wherein, when the button is pressed, the two ends of the button are electrically connected.

2. The circuit according to claim 1, further comprising:

a processor;

wherein an output end of the first ADC is connected to the processor, and an output end of the second ADC is connected to the processor; and wherein the processor is configured to read an output value of the first ADC and an output value of the second ADC, and compare the output value of the first ADC with the output value of the second ADC, and determine that the power supply is charging the earphone according to the comparison of the output value of the first ADC with the output value of the second ADC.

3. The circuit according to claim 1, further comprising:

a processor;

wherein an output end of the first ADC is connected to the processor, and an output end of the second ADC is connected to the processor; and wherein the processor is configured to read an output value of the first ADC and an output value of the second ADC, and compare the output value of the first ADC with the output value of the second ADC, and determine that the earphone does not comprise a charge circuit according to the comparison of the output value of the first ADC with the output value of the second ADC.

4. The circuit according to claim 1, wherein a difference between a first output value from the first ADC and a second output value from the second ADC indicates whether a charge circuit of the earphone is in a charging state.

5. The circuit according to claim 1, wherein a difference between a first output value from the first ADC and a second output value from the second ADC indicates whether the earphone comprises a charge circuit.

6. A terminal, comprising:

an earphone jack configured to connect the terminal to an earphone;

a first resistor, having a first end and a second end;

a comparator, having with a first input end, a second input end, and an output end, wherein the first input end of the comparator is connected to the first end of the first resistor, wherein the second input end of the comparator is connected to the second end of the first resistor, and wherein the comparator is configured to output a control signal at the output end of the comparator when a voltage difference between the first input end and the second input end is greater than a first threshold; and a power supply, connected to the first end of the first resistor;

a first analog to digital converter (ADC), wherein an input end of the first ADC is connected to the first end of the first resistor, and wherein an output end of the first ADC is connected to a processor; and a second ADC, wherein an input end of the second ADC is connected to the second end of the first resistor, and an output end of the second ADC is connected to the processor;

wherein the earphone comprises:

a second resistor, having a first end and a second end, wherein when the earphone is connected to the terminal through the earphone jack, the first end of the second resistor is connected to the second end of the first resistor;

a microphone (MIC), having a first end and a second end, wherein the first end of the MIC is connected to the first end of the second resistor, and the second end of the MIC is grounded; and a button, having two ends that are respectively connected to the second end of the MIC and the second end of the second resistor, wherein, when the button is pressed, the two ends of the button are electrically connected; and wherein the terminal further comprises the processor configured to receive the control signal, and to execute a function corresponding to the control signal.

7. The terminal according to claim 6, further comprising:

the processor is further configured to read an output value of the first ADC and an output value of the second ADC, and compare the output value of the first ADC with the output value of the second ADC, and when a difference between the output value of the first ADC and the output value of the second ADC is greater than a second threshold, determine that the power supply is charging the earphone.

8. The terminal according to claim 6, further comprising:

the processor is further configured to read an output value of the first ADC and an output value of the second ADC, and compare the output value of the first ADC with the output value of the second ADC, and according to a relationship between a difference between the output value of the first ADC and the output value of the second ADC and a third threshold, determine that the earphone does not comprise a charge circuit.

9. The terminal according to claim 6, further comprising:

a difference between a first output value from the output end of the first ADC and a second output value from the output end of the second ADC indicates whether a charge circuit of the earphone is in a charging state.

10. The terminal according to claim 6, further comprising:

a difference between a first output value from the output end of the first ADC and a second output value from the output end of the second ADC indicates whether the earphone comprises a charge circuit.

* * * * *